US011739285B2

(12) United States Patent
Zhao et al.

(10) Patent No.: US 11,739,285 B2
(45) Date of Patent: Aug. 29, 2023

(54) APPLICATION OF NANO COPPER IN CUTTING FLUID

(71) Applicant: FRANCOOL TECHNOLOGY (SHENZHEN) CO., LTD, Shenzhen (CN)

(72) Inventors: Yang Zhao, Shenzhen (CN); Jun Zhang, Shenzhen (CN); Dexiu Liu, Shenzhen (CN); Langgui Fan, Shenzhen (CN)

(73) Assignee: FRANCOOL TECHNOLOGY (SHENZHEN) CO., LTD, Shenzhen (CN)

( * ) Notice: Subject to any disclaimer, the term of this patent is extended or adjusted under 35 U.S.C. 154(b) by 0 days.

(21) Appl. No.: 17/581,971

(22) Filed: Jan. 23, 2022

(65) Prior Publication Data

US 2022/0145210 A1 May 12, 2022

Related U.S. Application Data

(63) Continuation of application No. PCT/CN2020/090041, filed on May 13, 2020.

(30) Foreign Application Priority Data

Jul. 23, 2019 (CN) ..... 201910666592.3

(51) Int. Cl.
*C10M 173/00* (2006.01)
*C10M 105/06* (2006.01)
(Continued)

(52) U.S. Cl.
CPC ..... *C10M 173/00* (2013.01); *C10M 105/06* (2013.01); *C10M 125/04* (2013.01);
(Continued)

(58) Field of Classification Search
CPC ..... C10M 173/00; C10M 105/06; C10M 125/04; C10M 125/26; C10M 129/40;
(Continued)

(56) References Cited

FOREIGN PATENT DOCUMENTS

CN 102554217 A 7/2012
CN 104357201 A 2/2015
(Continued)

OTHER PUBLICATIONS

International Search Report issued in corresponding international application No. PCT/CN2020/090041, dated Aug. 6, 2020.
(Continued)

*Primary Examiner* — Taiwo Oladapo

(57) ABSTRACT

The present invention provides an application of nano copper in a cutting fluid. The nano copper is self-dispersible nano copper with an organic long-carbon chain, wherein the surface of copper metal is coated with a long carbon chain organic matter, and the long chain organic matter is dialkyl dithiophosphoric acid (HDDP) and a derivative thereof. In the present invention, the nano copper substitutes functional additives which comprises one or more of a preservative, an anti-rust agent, a sterilizing agent, a compression-resisting agent and a lubricant to solve the technical problems of the existing fluid in the prior art being unable to simultaneously have efficient anti-corrosion, anti-rust, compression-resistant, lubricating and sterilizing properties as well as the variety, the relatively high amount, the high cost and the limited selection of added additives.

9 Claims, 1 Drawing Sheet

Drawing of the Specification

Left Right

(51) Int. Cl.

| | |
|---|---|
| ***C10M 125/04*** | (2006.01) |
| ***C10M 125/26*** | (2006.01) |
| ***C10M 129/40*** | (2006.01) |
| ***C10M 133/08*** | (2006.01) |
| ***C10M 133/44*** | (2006.01) |
| ***C10M 141/06*** | (2006.01) |
| ***C10M 145/36*** | (2006.01) |
| ***C10M 161/00*** | (2006.01) |
| *C10N 50/00* | (2006.01) |
| *C10N 40/20* | (2006.01) |
| *C10N 20/06* | (2006.01) |
| *C10N 40/22* | (2006.01) |

(52) U.S. Cl.
CPC ..... *C10M 125/26* (2013.01); *C10M 129/40* (2013.01); *C10M 133/08* (2013.01); *C10M 133/44* (2013.01); *C10M 141/06* (2013.01); *C10M 145/36* (2013.01); *C10M 161/00* (2013.01); *C10M 2201/05* (2013.01); *C10M 2201/087* (2013.01); *C10M 2203/065* (2013.01); *C10M 2207/126* (2013.01); *C10M 2209/108* (2013.01); *C10M 2215/26* (2013.01); *C10M 2215/30* (2013.01); *C10N 2020/06* (2013.01); *C10N 2040/22* (2013.01); *C10N 2040/245* (2020.05); *C10N 2050/011* (2020.05)

(58) Field of Classification Search
CPC ..... C10M 133/08; C10M 133/44; C10M 141/06; C10M 145/36; C10M 161/00; C10M 2201/05; C10M 2201/087; C10M 2203/065; C10M 2207/126; C10M 2209/108; C10M 2215/26; C10M 2215/30; C10M 2201/02; C10M 2203/106; C10M 2203/1065; C10M 2207/04; C10M 2209/104; C10M 2215/042; C10M 2215/223; C10M 2219/046; C10N 2020/06; C10N 2040/22; C10N 2040/245; C10N 2050/011; C10N 2030/12
See application file for complete search history.

(56) References Cited

FOREIGN PATENT DOCUMENTS

| | | | | |
|---|---|---|---|---|
| CN | 106467768 A | * | 3/2017 | |
| CN | 106635354 A | | 5/2017 | |
| CN | 107523387 B | * | 10/2020 | ..... C10M 105/38 |
| WO | WO-2019051596 A1 | * | 3/2019 | ..... C09K 5/10 |

OTHER PUBLICATIONS

Written Opinion of the International Searching Authority for No. PCT/CN2020/090041.

* cited by examiner

Drawing of the Specification
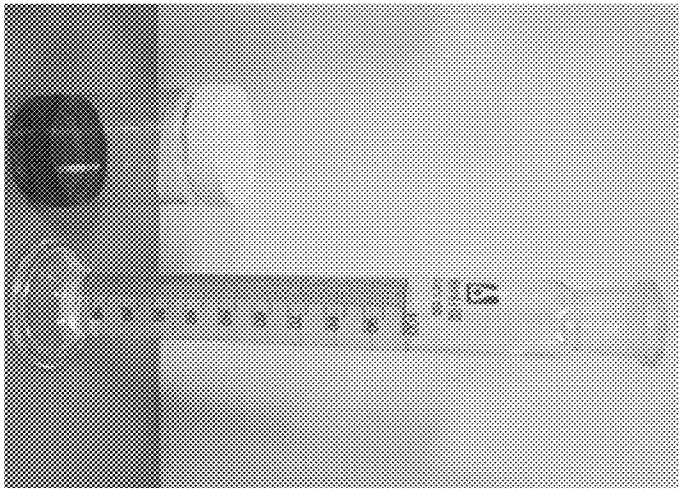
Left Right

APPLICATION OF NANO COPPER IN CUTTING FLUID

TECHNICAL FIELD

The present invention belongs to the technical field of nano copper materials, and particularly relates to an application of nano copper in a cutting fluid.

BACKGROUND ART

Metal cutting fluids play very important roles in metal cutting and grinding processes. By selecting a proper metal cutting fluid, the cutting temperature can be reduced by 60-150° C., the surface roughness can be reduced by 1-2 stages, and the cutting resistance can be reduced by 15-30%, contributing to prolonged service lives of cutting tools and grinding wheels by multiple times. Moreover, cutting fluid washes away scrap iron and dust from the cutting region, so that production efficiency and product quality are improved. The cutting fluid is widely applied in machining.

Metal cutting fluids can be generally divided into non-water-soluble cutting fluid and water-soluble cutting fluids. Generally, the cutting fluid has the following effects:

Cooling effect, that the temperature of the cutting region on a workpiece can be timely and efficiently reduced during the cutting and processing processes, that is, temperature rise generally caused by friction is reduced, the cutting efficiency, the cutting quality and the service life of cutting tools are also improved by cooling.

Lubricating effect, that friction between the cutting tool and the workpiece can be reduced. Lubricating liquid can permeate onto the contact surface between the tool and the workpiece, and efficiently wet the cuttings, thereby reducing friction and adhesion, reducing cutting resistance, guaranteeing cutting quality and prolonging the service life of the tool.

Washing effect, that the cuttings or abrasive particles can be flushed away to leave the processing region, so that the cuttings or the abrasive metallic particles are prohibited from being adhered onto the workpiece, the tool and other surfaces to affect the follow-up processing.

Anti-rust effect, that certain anti-rust property is achieved to prevent the workpiece and the machine tool from rusting.

The cooling, lubricating, washing and anti-rust effects are not completely isolated, and could exhibit both synergistic and opposing aspects. For example, the non-water-soluble cutting fluid is good in lubricating and anti-rust properties, but inferior in cooling and washing properties. The water-soluble cutting fluid is good in cooling and washing properties, but inferior in lubricating and anti-rust properties.

In recent years, the application of metal cutting fluids gradually shifts towards the water-soluble division. The water-soluble cutting fluids can be divided into semi-synthetic cutting fluid, totally-synthetic cutting fluid and emulsion type cutting fluid. The semi-synthetic cutting fluid has gradually emerged as the new mainstream in the field of processing aluminum and magnesium alloys, and the like. This cutting fluid performs mixed-flow processing on different parts in same equipment, so that various cutting processes such as tuning, drilling, milling, grinding, boring and reaming can be accomplished. However, the semi-synthetic cutting fluid still has the large-scale industrialization problem at present.

The main challenges of the existing semi-synthetic cutting fluid include: (1) the corrosion and rust prevention problem of alloys, where an anti-rust agent selected in the prior art mainly includes monoethanolamine, diethanolamine, triethanolamine, boric acid, sodium petroleum sulfonate and alkyl phosphite; (2) the lubricating problem of an alloy cutting fluid system, where a lubricant selected in the prior art is mainly polyether; and (3) the anti-bacterial problem of the alloy cutting fluid, wherein a sterilizing agent selected in the prior art includes triazine, morpholine, thiazolinone and the like.

In the semi-synthetic cutting fluid in the prior art, adding amount of the general anti-rust agent is 10%-15%, and the adding amount of the lubricant is 5%-10%. The sterilizing agent, with small adding amount, generally about 1%, is relatively considerable in actual adding amount as a result of higher cost and repeated adding along with continuous consumption after long-time use. The adding amount of alkyl phosphite, as an efficient anti-rust agent, can be reduced to about 1%-2%. However, expansion of usage scenarios is greatly reduced as a result of the high price of the anti-rust agent.

Relative to the semi-synthetic cutting fluid and the totally-synthetic cutting fluid, the formula of the emulsion type cutting fluid generally includes a higher proportion (50%-80%) of mineral oil. After being mixed with water for use, the emulsion type cutting fluid can integrate the lubricating property of non-aqueous cutting fluid and good heat conduction of aqueous cutting fluid. However, the extreme pressure resistant property, the lubricating property, the anti-bacterial property and the anti-rust property still need to be taken into consideration. An additive problem still exists in preparation of the semi-synthetic cutting fluid.

In addition, the choices of additives on the market today are relatively restricted, and therefore, all cutting fluid formulas are limited by the limitation of the additives. Affected by fluctuation in the international market and trade disputes, the prices and supply chain of the additives also constantly fluctuate, thereby bringing greater uncertainty to the industry.

Metal nano-particles are metal particles with their sizes reduced to nano-scale (5-100 nm) in form. The chemical bonding structure of the novel nano-material is different from that of metal particles with same chemical components. Since the German scientist Gleiter H first prepared 6 nm iron nano-particles in 1984, the world's research on nano-metals has been vigorously carried out with great progress. With research being started early, the nano copper material can serve as a catalyst to prepare "superplastic" steel and a gas sensor, and also can serve as a solid lubricant.

So far, the preparation of nano copper is mainly limited to solid nano copper powder. With characteristics of small size, massive surface area, small electronic resistance, quantum size effect, macro quantum tunneling effect and the like, the nano copper powder (10-100 nm) has some novel properties different from those of a conventional metallic material. In recent years, research on the preparation, property and application of the nano copper powder have attracted more and more attention worldwide.

Nano copper powder has many applications: 1, the nano copper powder, used as solid lubricant, can be properly dispersed in various lubricating oil to form stable suspension liquid. Each liter of the oil contains millions of superfine metal powder particles whose combined surface could form a smooth protective layer to fill up micro scratches on the contact surface, so that friction and wear can be greatly reduced, and especially, the friction reduction under heavy-load, low-speed and high-temperature vibration conditions is more remarkable; 2, nano copper powder with high electric conductivity is used for conductive materials, and can also be used for manufacturing conductive slurry (conductive glue, magnetic conduct adhesive) which is widely used as bonding resin for conductive cloth, conductive sealing tape, and other conductive products; and nano copper powder also plays an important role in miniaturization of microelectronic devices; 3, nano copper powder is used for manufacturing a nano copper material; nano copper with high density and high purity which is synthesized through a novel process has a particle size of only 30 nm, has super-plastic extensibility at the room temperature according to further cold-rolling experiment, and can deform by 50 times or more without cracks at room temperature, which was published in related paper in Science on Feb. 25, 2000. PG Sanders et al. obtained the tensile mechanical properties of the nano copper material (particle size of 10-110 nm), and found that its yield strength was 10 times (~300 MPa) that of general annealed copper (particle size of 20 μm), and its elongation was 8% or higher. Therefore, copper nano particle, which obviously improves the strength and the plasticity, is of significant value in fine processing, micro mechanical manufacturing of materials. In addition, the nano copper powder further has a higher application value in modified phenolic resin, medication adjustment materials for treating osteoporosis, hyperostosis and the like, the aviation field, and the like.

The application, in the lubricating field, of the nano copper powder is still greatly limited by poor dispersion. In the prior art, a conventional method for preparing a nano copper powder lubricating oil additive includes firstly preparing the nano copper powder and then adding the nano copper powder into the lubricating oil. However, the nano copper particles are liable to agglomerate as a result of a small particle size, high surface energy, attraction among the particles and a great automatic agglomeration trend while added into the lubricating oil. The particles will re-agglomerate during mutual collision to have coagulation even if being forcibly dispersed in the lubricating oil. In case of agglomeration, precipitation or denaturation, the particles tends not to exhibit any beneficial characteristics, and may even have negative effects on a mechanical system.

Chinese Patent Application No. 201810835770.6, entitled "Anti-wear Nanometer Copper Lubricating Oil" specifically discloses a preparation method of anti-wear nanometer copper lubricating oil. According to the method, nano copper is uniformly dispersed in base oil by mixing ethyl alcohol suspension of nano copper and the base lubricating oil, which is subsequently combined with a non-ionic surfactant to reduce surface tension of the base lubricating oil, so that agglomeration of the nano copper particles is prevented and suspension stability of nano copper is improved. In such a manner, anti-wear property of the nano copper lubricating oil is improved. This invention is still limited by application of the nano copper through a method of dispersing the nano copper powder. Although the added non-ionic surfactant can improve dispersion property of the nano copper within certain time, yet the method cannot avoid aggregation and sedimentation of the nano copper after long time. The application scenario of the present invention is a lubricating oily system which is greatly different from an aqueous emulsion system of the cutting fluid.

Chinese Patent Application No. 201611157432.9, entitled "Nano Copper Lubricated Micro-emulsification Cutting Solution" specifically discloses a preparation of a nano copper lubricated micro-emulsion cutting solution. The nano copper powder added in the method has very good lubricating and wear-reducing effects, but is easily agglomerated and not easily dispersed while directly added into water-based cutting fluid, so that an excellent wear-reducing effect cannot be achieved in latter scenarios. A chemically oxidative synthesis method is needed for generating polyaniline on the surface of the nano copper in situ, so that polyaniline achieves feasible dispersion and stability in the water-based cutting fluid. However, this method which needs to firstly prepare the nano copper powder and then generate polyaniline in situ for coating, is too complex, thereby causing production of the cutting fluid more complex and difficult to control. Meanwhile, the application scenario of the cutting fluid system has an unignorable issue with long-term high-strength shear force. The acting force is enough to shear polymers such as polyaniline into smaller molecular fragments within short time to inactivate the polymer. Furthermore, under such circumstance small molecular fragments with carcinogenic toxicity such as phenylamine are introduced into the cutting fluid system, so that the service life of the cutting fluid is greatly shortened, and workers' health is jeopardized.

SUMMARY OF THE INVENTION

To solve the technical problems, the present invention provides an application of nano copper really having commercial application value in a cutting fluid. Self-dispersible nano copper with an organic long-carbon chain substitutes functional additives including one or more of a preservative, an anti-rust agent, a sterilizing agent, a compression-resisting agent and a lubricant, thereby solving the technical problems of nano copper in the prior art being difficult to stably exist in the cutting fluid, and the existing fluid being unable to simultaneously have efficient anti-corrosion, anti-rust, compression-resisting, lubricating and sterilizing properties as well as the variety, the relatively high amount, the high cost and the limited selection of added additives.

The present invention provides an application of nano copper in a cutting fluid. The nano copper is self-dispersible nano copper with an organic long-carbon chain.

Preferably, the nano copper is a copper metal surface coated with a long-carbon chain organic matter. The long-carbon chain organic matter is dialkyl dithiophosphate (HDDP) and a derivative thereof. In addition, the carbon number of the long-carbon chain is greater than 8, and the cutting fluid is an aqueous cutting fluid.

Preferably, the mass percentage, in the cutting fluid, of the nano copper is 1%-10%. The nano copper is paste with a particle size of 10-50 nm.

Preferably, the nano copper substitutes part or all of the functional additives in the cutting fluid, and the functional additives include one or more of a preservative, an anti-rust agent, a sterilizing agent, a compression-resisting agent and a lubricant.

Preferably, the cutting fluid is an aqueous aluminum alloy semi-synthetic cutting fluid, and includes the following components in percentage by mass:

| | |
|---|---|
| Nano copper | 1-10% |
| T22 naphthenic oil | 20-30% |
| Potassium oleate | 2-10% |
| Triethanolamine | 3-8% |
| Oleyl alcohol polyoxyethylene ether | 3-8% |
| Methyl diethanolamine | 1-6% |
| Boric acid | 1-6% |
| Oleic acid | 1-5% |
| Coupling agent | 0.5-2% |
| Isopropanolamine | 0.5-2% |
| Benzotrizaole | 0.1-1% |

-continued

| | |
|---|---|
| Defoamer | 0.01-0.1% |
| and the balance of water, | based on 100% in total. |

Preferably, the cutting fluid is an aqueous aluminum alloy semi-synthetic cutting fluid, and includes the following components in percentage by mass:

| | |
|---|---|
| Nano copper | 3% |
| T22 naphthenic oil | 24% |
| Potassium oleate | 5.8% |
| Triethanolamine | 5.5% |
| Oleyl alcohol polyoxyethylene ether | 5.5% |
| Methyl diethanolamine | 3.5% |
| Boric acid | 3% |
| Oleic acid | 2% |
| Coupling agent | 1% |
| Isopropanolamine | 0.8% |
| Benzotrizaole | 0.5% |
| Defoamer | 0.05% |
| Water | 45.35%. |

Preferably, the cutting fluid is an aqueous magnesium alloy semi-synthetic cutting fluid, and includes the following components in percentage by mass:

| | |
|---|---|
| Nano copper | 1-10% |
| T22 naphthenic oil | 25-35% |
| Petroleum sodium sulfonate | 8-15% |
| Anionic chelating agent | 2-10% |
| Mixed alcohol amine | 5-10% |
| Oleyl alcohol polyoxyethylene ether | 2-5% |
| Fatty alcohol polyoxylethylene ether | 2-5% |
| Tall oil | 3-8% |
| Coupling agent | 5-10% |
| Sterilizing agent | 0.5-2% |
| Benzotrizaole | 0.1-1% |
| Defoamer | 0.01-0.1% |
| and the balance of water, | based on 100% in total. |

Preferably, the cutting fluid is an aqueous magnesium alloy semi-synthetic cutting fluid, and includes the following components in percentage by mass:

| | |
|---|---|
| Nano copper | 3% |
| T22 naphthenic oil | 31.95% |
| Petroleum sodium sulfonate | 11% |
| Anionic chelating agent | 6% |
| Mixed alcohol amine | 6.5% |
| Oleyl alcohol polyoxyethylene ether | 3% |
| Fatty alcohol polyoxylethylene ether | 3% |
| Tall oil | 4% |
| Coupling agent | 8% |
| Sterilizing agent | 1% |
| Benzotrizaole | 0.5% |
| Defoamer | 0.05% |
| Water | 22%. |

Preferably, the cutting fluid is an emulsion type cutting fluid, and includes the following components in percentage by mass:

| | |
|---|---|
| Nano copper | 1-10% |
| T22 naphthenic oil | 50-70% |
| Petroleum sodium sulfonate | 5-10% |
| Oleic acid | 4-6% |
| Triethanolamine | 1-3% |
| Monoethanolamine | 1-3% |
| Fatty alcohol polyoxylethylene ether | 1-3% |

-continued

| | |
|---|---|
| Diethylene glycol monobutyl ether | 0.5-2% |
| Boric acid | 1-3% |
| Mixed binary acid (C10-C12) | 0.1-1% |
| Span 80 | 2-5% |
| Sterilizing agent | 0.5-2% |
| Benzotrizaole | 0.1-1% |
| Defoamer | 0.01-0.1% |
| and the balance of water, | based on 100% in total. |

Preferably, the cutting fluid is an emulsion type cutting fluid, and includes the following components in percentage by mass:

| | |
|---|---|
| Nano copper | 3% |
| T22 naphthenic oil | 69.95% |
| Petroleum sodium sulfonate | 7% |
| Oleic acid | 5% |
| Triethanolamine | 1.5% |
| Monoethanolamine | 1.5% |
| Fatty alcohol polyoxylethylene ether | 2% |
| Diethylene glycol monobutyl ether | 1% |
| Boric acid | 1.5% |
| Mixed binary acid (C10-C12) | 0.5% |
| Span 80 | 2.5% |
| Sterilizing agent | 1% |
| Benzotrizaole | 0.4% |
| Defoamer | 0.05% |
| Water | 3.1%. |

The beneficial effects are that:

According to the application in the cutting fluid the nano copper provided in the present invention has the organic long-carbon chain, is self-dispersible, can stably exist in the cutting fluid, and can be directly, stably and uniformly dispersed in the aqueous emulsion type cutting fluid and even the totally-synthetic water-soluble cutting fluid, substituting the functional additives in the conventional cutting fluid formula that include one or more of the preservative, the anti-rust agent, the sterilizing agent, the compression-resisting agent and the lubricant. On one hand, the cutting fluid simultaneously has efficient anti-corrosion, anti-rust, compression-resistant, lubricating, and sterilizing properties, on the other hand, the formula system of the cutting fluid is greatly simplified, the production cost is reduced, and the production steps are simplified.

BRIEF DESCRIPTION OF DRAWING

In order to make the content of the present invention easier to understand, the present invention will be further described in detail below in accordance with the specific embodiments of the present invention and in conjunction with the drawing.

FIG. 1 is a schematic diagram showing a stock solution of a nano copper cutting fluid and a 5% aqueous solution of a nano copper cutting fluid in Embodiment 1 of the present invention.

DETAILED DESCRIPTION

In order to describe the technical content, achieved objectives and effects of the present invention in detail, the following description will be given in conjunction with the embodiments.

The reagents adopted in the specification, unless otherwise specified, are all commercially available products.

According to the application, in the cutting fluid, of the self-dispersible nano copper with the organic long-carbon chain provided in the present invention, the mass percentage, in the cutting fluid, of the nano copper is 1-10%, preferably 2-5%. The nano copper is a metal surface coated with a long-carbon chain organic matter. The long-carbon chain organic matter is dialkyl dithiophosphate (HDDP) and a derivative thereof.

The preparation method of the self-dispersible nano copper with the organic long-carbon chain includes the following steps.

Step 1: mixing a copper source with water to obtain a copper source solution, putting the copper source solution into nitrogen, argon or air atmosphere to heat up to 40° C.-75° C., preferably 50° C.-65° C., more preferably 55° C., where the copper source aqueous solution is selected from one or more of a copper sulfate pentahydrate aqueous solution, a copper chloride aqueous solution, a copper bromide aqueous solution, a copper acetate aqueous solution, a copper nitrate aqueous solution and an copper acetylacetonate aqueous solution.

Step 2: adding a reducing agent into the copper source solution heated in step 1 to obtain a reduced copper source solution, where the reducing agent is selected from one or more of hydrazine hydrate, sodium hypophosphite ($NaH_2PO_2$), sodium borohydride, ascorbic acid (vitamin C) and sodium ascorbate.

Step 3: mixing a dialkyldithiophosphate coating agent with an organic solvent to obtain a coating agent solution, where the organic solvent is selected from one or more of petroleum ether 60-90, dichloromethane, trichloromethane, pentane, ethyl acetate, diethyl ether, carbon tetrachloride, benzene, methylbenzene, dimethylbenzene and base oil.

Step 4: adding the coating agent solution into the reduced copper source solution to react, thereby obtaining a nano copper mixture.

Before step 1 starts, the HDDP coating agent is firstly prepared: a carbon-based alcohol compound reacts with phosphorus pentasulfide to obtain the dialkyldithiophosphate coating agent. In the embodiment, a molar ratio of the carbon-based alcohol compound to the phosphorus pentasulfide can be selected according to the practical needs, preferably 2:1 to 8:1. The carbon-based alcohol compound may be fatty alcohol and aromatic alcohol, preferably at least one of saturated fatty alcohols, for example, one or more of alcohol, isopropanol, isooctanol, decanol, n-dodecyl alcohol and dodecyl isomeric alcohol.

A molar ratio of the copper source to the dialkyldithiophosphate coating agent may be adjusted according to the specific needs, preferably 1:5 to 5:1. Preferably, the molar ratio of the copper source to the reducing agent is 1:20 to 20:1.

The method may further include: performing fluid separation treatment on the nano copper mixture, and removing a lower-layer water phase to obtain an upper-layer oil phase; centrifuging the oil phase to obtain upper-layer liquor; and concentrating the upper-layer liquor to obtain nano copper paste. The particle size of the nano copper is detected to be 10-50 nm through a nano particle size detector. A mass ratio of pure copper in nano copper preparation is measured to be 20%-25% through a thermal gravimetric analyzer.

The aqueous aluminum alloy semi-synthetic cutting fluid provided in the present invention includes the following components in percentage by mass: 1-10%, preferably 2-5% of nano copper, 20-30%, preferably 22-25% of T22 naphthenic oil, 2-10%, preferably 4-6% of potassium oleate, 3-8%, preferably 4-6% of triethanolamine, 3-8%, preferably 4-6% of oleyl alcohol polyoxyethylene ether, 1-6%, preferably 3-5% of methyl diethanolamine, 1-6%, preferably 3-5% of boric acid, 1-5%, preferably 2-3% of oleic acid, 0.5-1% of a coupling agent, 0.5-2%, preferably 0.5-1% of isopropanolamine, 0.1-1%, preferably 0.4-0.6% of benzotriazole, 0.04-0.06% of a defoamer, and the balance of water, based on 100% in total.

The self-dispersible nano copper with the organic long-carbon chain can be directly applied to the preparation of the aluminum alloy cutting fluid, can be taken as a multi-functional additive to simultaneously substitute the anti-rust agent (alkyl phosphorous acid), the lubricant (polyether) and the sterilizing agent, so that the production cost of the cutting fluid is remarkably reduced.

The cutting fluid provided in the present invention is the aqueous magnesium alloy semi-synthetic cutting fluid, and includes the following components in percentage by mass: 1-10%, preferably 2-5% of nano copper, 25-35%, preferably 30-35% of T22 naphthenic oil, 8-15%, preferably 10-12% of petroleum sodium sulfonate, 2-10%, preferably 5-8% of an anionic chelating agent, 5-10%, preferably 5-8% of mixed alcohol amine, 2-5%, preferably 2-4% of oleyl alcohol polyoxyethylene ether, 2-5%, preferably 2-4% of fatty alcohol polyoxylethylene ether, 3-5% of tall oil, 5-10%, preferably 6-8% of a coupling agent, 0.5-2%, preferably 0.5-1% of a sterilizing agent, 0.4-0.6% of benzotriazole, 0.04-0.06% of a defoamer, and the balance of water, based on 100% in total.

The self-dispersible nano copper with the organic long-carbon chain can be directly applied to the preparation of the magnesium alloy cutting fluid, and completely substitutes the conventional dicarboxylic acid to serve as an anti-corrosion additive. Meanwhile, extra lubricating effect and sterilizing effect are brought to the cutting fluid system after nano copper is introduced, so that the proportion of other additives is further reduced, and the cost of the formula is reduced.

The cutting fluid provided in the present invention is the emulsion type cutting fluid, and includes the following components in percentage by mass: 1-10%, preferably 2-5% of nano copper, 50-70%, preferably 65-70% of T22 naphthenic oil, 5-10%, preferably 7-9% of petroleum sodium sulfonate, 4-6% of oleic acid, 1-3%, preferably 1-2% of triethanolamine, 1-3%, preferably 1-2% of monoethanolamine, 1-3%, preferably 1-2% of fatty alcohol polyoxylethylene ether, 0.5-2%, preferably 0.5-1% of diethylene glycol monobutyl ether, 1-3%, preferably 1-2% of boric acid, 0.1-1% of mixed dicarboxylic acid (C10-C12), 2-5%, preferably 2-3% of Span 80, 0.5-2%, preferably 0.5-1% of a sterilizing agent, 0.1-1%, preferably 0.2-0.5% of benzotriazole, 0.01-0.1%, preferably 0.04-0.06% of a defoamer, and the balance of water, based on 100% in total.

The self-dispersible nano copper with the organic long-carbon chain can be directly applied to the preparation of the aluminum alloy cutting fluid, is taken as a multi-functional additive to simultaneously substitute the anti-rust agent (alkyl phosphorous acid), the lubricant (polyether and Span 80) and the sterilizing agent, so that the production cost of the cutting fluid is remarkably reduced.

The stable dispersion, in the cutting fluid, of the nano copper matter prepared in the present invention benefits from two main factors: firstly, a great deal of coating agent is introduced in the preparation process, and the nano copper is bonded with the coating agent to generate a stable nano copper cluster; a mass main body of the cluster is the coating agent, and therefore, the cluster mainly exhibits the physical property of coating agent molecules instead of the physical property of the exposed nano copper powder; and secondly, the cutting fluid system is generally a mixed system including a great number of surface activator molecules through which the coated nano copper cluster can be well dispersed into micelles of emulsion liquid or directly dissolved into water without forming an independent oil layer or sediments. If only the exposed nano copper powder is simply added, the dispersion effect will be difficult to achieve due to the lack of effective acting force and an acting position on the surface.

Embodiment 1

An aqueous aluminum alloy semi-synthetic cutting fluid in the embodiment included the following components in percentage by mass:

| | |
|---|---|
| Nano copper | 3% |
| T22 naphthenic oil | 24% |
| Potassium oleate | 5.8% |
| Triethanolamine | 5.5% |
| Oleyl alcohol polyoxyethylene ether | 5.5% |
| Methyl diethanolamine | 3.5% |
| Boric acid | 3% |
| Oleic acid | 2% |
| Coupling agent | 1% |
| Isopropanolamine | 0.8% |
| Benzotrizaole | 0.5% |
| Defoamer | 0.05% |
| Water | 45.35%. |

A preparation method of self-dispersible nano copper with an organic long-carbon chain included the following steps.

A HDDP coating agent was firstly prepared: a carbon-based alcohol compound and phosphorus pentasulfide were added into a 250 mL simple-opening flask, the opening of which was covered with a plug and connected to a gas guide tube, a reaction mixture was heated up to 80° C. under a stirring condition and was kept at the temperature for 3 h, and hydrogen sulfide gas released during the reaction was introduced into a copper sulfate aqueous solution through the gas guide tube. Residual solids in the reaction system were removed after the reaction to obtain transparent light-yellow liquid, namely the dialkyldithiophosphate coating agent. In the embodiment, hydrogen sulfide gas generated during the reaction also could be sucked through alkaline systems such as a sodium hydroxide aqueous solution, a potassium hydroxide aqueous solution, a calcium hydroxide aqueous solution or emulsion. The hydrogen sulfide gas also could be transformed into sulfur dioxide through a combustion or oxidation method for being sucked.

Step 1: a copper source and water were added into a 500 mL beaker, so that the copper source was sufficiently dissolved into water to obtain a copper source solution; the copper source solution was poured into a reaction kettle which was then closed; and nitrogen gas was introduced into the reaction kettle to heat up a reaction system to 55° C.

Step 2: a reducing agent was added into the reaction kettle and reaction was performed for 10 min under the stirring condition.

Step 3: a dialkyldithiophosphate coating agent and an organic solvent were mixed in final concentration of 0.1 mol/L to 0.9 mol/L to obtain a coating agent solution.

Step 4: the coating agent solution was added into the reaction kettle, and stirring and heating were stopped after reaction was performed for 2 h.

Step 5: a nano copper mixture was obtained.

The method further included a step 6: the nano copper mixture was poured out from the reaction kettle, liquid separation was performed on the mixture through a liquid separation funnel, and a lower-layer water phase was removed to obtain an upper-layer oil phase; the obtained oil phase was centrifuged to remove relatively great copper powder particles, so that upper-layer liquor was obtained; and the upper-layer liquor was evaporated rotationally, and the solvent was removed to obtain nano copper paste. The upper-layer liquor was purified through reduced-pressure distillation or normal-pressure distillation.

The prepared nano copper was directly applied to the preparation of the aluminum alloy cutting fluid, could be taken as a multi-functional additive to simultaneously substitute the anti-rust agent (alkyl phosphorous acid), the lubricant (polyether) and the sterilizing agent, so that the production cost of the cutting fluid was remarkably reduced. As shown in FIG. 1, the stock solution of the nano copper cutting fluid was at the left side, and a 5% aqueous solution of the nano copper cutting fluid was at the right side, both of which were in a micro-emulsion semi-transparent state.

The embodiment further provided a reference sample 1 in which nano copper was not added as a comparison, where the formula was as shown in table 1.

TABLE 1

Formula of reference example

| Additive | Cutting Fluid (without nano copper) in reference example 1 Content (mass ratio %) |
|---|---|
| Boric acid | 3 |
| Mixed binary acid (C10-C12) | 2 |
| Potassium oleate | 5.8 |
| Benzotrizaole | 0.5 |
| Isopropanolamine | 0.8 |
| Triethanolamine | 5.5 |
| Methyl diethanolamine | 3.5 |
| Water | 36.35 |
| Chlorinated paraffin (C14-C17) | 4 |
| Oleyl alcohol polyoxyethylene ether | 5.5 |
| Oleic acid | 2 |
| Coupling agent | 2 |
| Sterilizing agent | 2 |
| T22 naphthenic oil | 24 |
| Nano copper | 0 |
| Defoamer | 0.05 |
| In total | 100 |

An anti-rust test was performed on the nano copper cutting fluid in Embodiment 1 and the nano copper-free cutting fluid in reference example as shown in the following Table 2.

TABLE 2

Comparison between the nano copper cutting fluid in Embodiment 1 and the nano copper-free cutting fluid in reference example.

| Test Items | Cutting Fluid (containing nano copper) in Embodiment 1 | Cutting Fluid (without nano copper) in reference example 1 | Test Standards |
|---|---|---|---|
| pH (25° C.) | 9.5 | 9.2 | GB/T 6144 |
| Anti-rust experiment, first-grade grey cast iron, 24 hours | Grade A | Grade A | GB/T 6144 |

TABLE 2-continued

Comparison between the nano copper cutting fluid in Embodiment 1 and the nano copper-free cutting fluid in reference example.

| Test Items | Cutting Fluid (containing nano copper) in Embodiment 1 | Cutting Fluid (without nano copper) in reference example 1 | Test Standards |
|---|---|---|---|
| Anti-rust experiment, LY12 hard aluminum, 8 hours | Grade A | Grade B | GB/T 6144 |
| Anti-rust experiment, cast-iron scrap method, 2 hours | No rust spot, grade e | One to two rust spots | GB/T 6144 |
| Sedimentation experiment | No sedimentation for six mouths | — | |

The results showed that, for the cutting fluid in Embodiment 1, the added nano copper substituted alkyl phosphorous acid with a high price in case of not reducing the anti-rust effect of an aluminum alloy. Meanwhile, the cutting fluid did not need polyether and other sterilizing agents due to its remarkable lubricating and sterilizing properties, so that the formula system of the cutting fluid was greatly simplified, and the production steps were simplified while the cost was reduced. Sedimentation experiment was further performed on the cutting fluid in the embodiment, and the test results showed that there were no sediments 6 months later, and therefore, the nano copper in the embodiment was stably and uniformly dispersed in the aqueous aluminum alloy semi-synthetic cutting fluid for a long time.

The nano copper in the application of the embodiment exhibited efficient anti-corrosion property on the aluminum alloy due to the following reasons.

A coating agent of the nano copper was formed by phosphorodithioate with a long organic carbon chain, and phosphorodithioate exhibited very efficient bonding ability for an aluminum alloy surface, so that the aluminum alloy surface was coated with coating agent molecules to isolate from water.

The nano copper cluster in nano copper paste could be effectively deposited on the aluminum alloy surface in the processing process, so that a second isolating layer was generated by the alloy surface and water, and thus, the anti-corrosion property was further strengthened.

The nano copper improved the lubricating property of the aluminum alloy cutting fluid due to the fact that:

Phosphorodithioate exhibited very efficient bonding capacity with the aluminum alloy surface and formed an extreme pressure resistant oil film, so that the aluminum alloy surface is lubricated. Phosphorodithioate and a steel tool generated chemical reaction in a processing process to generate an iron sulfide film, so that the tool surface exhibited equivalent extreme pressure resistant property and lubricating property. Antibacterial ability of the nano copper was due to stabilizing ability of the nano copper cluster. Although the surface of the nano copper cluster was coated with phosphorodithioate, yet the effect was reversible. A few coating agent molecules were free in a processing process, so that the surface of the nano copper cluster was exposed to exhibit the antibacterial ability.

Embodiment 2

An aqueous magnesium alloy semi-synthetic cutting fluid in the embodiment included the following components in percentage by mass:

| | |
|---|---|
| Nano copper | 3% |
| T22 naphthenic oil | 31.95% |
| Petroleum sodium sulfonate | 11% |
| Anionic chelating agent | 6% |
| Mixed alcohol amine | 6.5% |
| Oleyl alcohol polyoxyethylene ether | 3% |
| Fatty alcohol polyoxylethylene ether | 3% |
| Tall oil | 4% |
| Coupling agent | 8% |
| Sterilizing agent | 1% |
| Benzotrizaole | 0.5% |
| Defoamer | 0.05% |
| Water | 22%. |

A preparation method of self-dispersible nano copper with an organic long-carbon chain in the embodiment was the same with that in Embodiment 1, and the difference was that:

In step 1, the carbon-based alcohol compound is a mixture consisting of 65% (in molar percentage) of n-dodecyl alcohol, 20% of isooctanol and 15% of alcohol, where the total mass was 53.9 g (350 mmol), dosage of phosphorus pentasulfide was 22.2 g (100 mmol), and a molar ratio of mixed alcohol to phosphorus pentasulfide was 3.5:1, and a dialkyldithiophosphate mixture was finally obtained in step 1.

In step 2, the copper source was copper sulfate pentahydrate with dosage of 37.4 g (150 mmol), 200 mL water was used for dissolving copper sulfate pentahydrate, a reducing agent was 80% hydrazine hydrate with dosage of 120 mL (about 2 mol), dosage of the dialkyldithiophosphate mixture was 48 g (120 mmol), a molar ratio of copper sulfate pentahydrate to the reducing agent was 3:40, a molar ratio of copper sulfate pentahydrate to dialkyldithiophosphate was 5:4 and the organic solvent was petroleum ether 60-90 with dosage of 250 mL.

The prepared self-dispersible nano copper was directly applied to the preparation of the magnesium alloy cutting fluid, and completely substituted the conventional dicarboxylic acid to serve as an anti-corrosion additive. Meanwhile, extra lubricating effect and sterilizing effect were brought to the cutting fluid system after nano copper was introduced, so that the proportion of other additives was further reduced, and the cost of the formula was reduced. The embodiment further provided a reference sample 2 in which nano copper was not added as a comparison, where the formula was as shown in table 3.

TABLE 3

Formula of reference example

| Additive | Content (mass ratio %) |
|---|---|
| Anionic chelating agent | 6 |
| Benzotrizaole | 0.5 |
| Mixed alcohol amine | 6.5 |
| Water | 22 |
| Petroleum sodium sulfonate | 11 |
| Oleyl alcohol polyoxyethylene ether | 3.5 |
| Fatty alcohol polyoxylethylene ether | 3.5 |
| Coupling agent | 8 |
| Sterilizing agent | 2 |
| Tall oil | 4 |
| T22 naphthenic oil | 32.95 |
| Nano copper | 0 |
| Defoamer | 0.05 |
| In total | 100 |

An anti-rust test was performed on the cutting fluid in Embodiment 2 and the nano copper-free cutting fluid in reference example as shown in the following Table 4.

TABLE 4

Comparison between the cutting fluid in Embodiment 2 and the nano copper-free cutting fluid in reference example

| Test Items | Cutting Fluid (containing nano copper) in Embodiment 2 | Cutting Fluid (without nano copper) in reference example | Test Standards |
|---|---|---|---|
| pH (25° C.) | 9.5 | 9.2 | GB/T 6144 |
| Anti-rust experiment, first-grade grey cast iron, 24 hours | Grade A | Grade A | GB/T 6144 |
| Anti-rust experiment, cast-iron scrap method, 4 hours | no rust spot, grade e | One to two rust spots | GB/T 6144 |
| Magnesium alloy normal-temperature soaking experiment, 5 days | No color change | Not changed color | Magnesium blocks were grounded and soaked in an aqueous solution of a 5% stock solution of the cutting fluid at the room temperature, and a color changing phenomenon of the magnesium blocks was observed at the room temperature |
| Magnesium alloy high-temperature soaking experiment, 12 hours | No color change | Slightly blackened | Magnesium blocks were grounded and soaked in an aqueous solution of a 5% stock solution of the cutting fluid at the room temperature, and a color changing phenomenon of the magnesium blocks was observed at 60° C. |
| Sedimentation experiment | No sedimentation for six mouths | — | |

The results showed that, for the cutting fluid in Embodiment 2, the adding proportion of the nano copper in the magnesium alloy cutting fluid could be reduced to about 1% of cost advantage, which formed striking comparison with the adding proportion of 15% dicarboxylic acid, sufficiently exhibited high efficiency, on the anti-corrosion effect of the magnesium alloy, of the nano copper and low cost of the prepared cutting fluid. Sedimentation experiment was further performed on the cutting fluid in the embodiment, and the test results showed that there were no sediments 6 months later, and therefore, the nano copper t was stably and uniformly dispersed in the aqueous aluminum alloy semi-synthetic cutting fluid in the embodiment for a long time.

The nano copper in the application of the embodiment exhibited efficient anti-corrosion property on the magnesium alloy due to the following reasons.

The coating agent of nano copper was formed by phosphorodithioate with a long organic carbon chain. The phosphorodithioate exhibited very efficient bonding ability with a magnesium alloy surface, so that the magnesium alloy surface was coated with coating agent molecules to isolate from water.

The nano copper cluster in nano copper paste could be effectively deposited on the magnesium alloy surface in the processing process, so that a second isolating layer was generated by the alloy surface and water to further strength the anti-corrosion property.

In the processing process, magnesium metal reacted with thiophosphoric acid to generate a little magnesium thiophosphate which was deposited on a metal surface to form a third isolating layer. The nano copper with a long-carbon chain exhibited high anti-corrosion property on the magnesium alloy, and quantity demanded on the nano copper was greatly reduced, so that the integral cost of the cutting fluid was remarkably reduced. In addition, the proportion of other related additives, which was also one of causes to the reduction of the proportion cost, was reduced due to the lubricating effect and the sterilizing effect of nano copper.

Embodiment 3

An emulsion type cutting fluid in the embodiment included the following components in percentage by mass:

| | |
|---|---|
| Nano copper | 3% |
| T22 naphthenic oil | 69.95% |
| Petroleum sodium sulfonate | 7% |
| Oleic acid | 5% |
| Triethanolamine | 1.5% |
| Monoethanolamine | 1.5% |
| Fatty alcohol polyoxylethylene ether | 2% |
| Diethylene glycol monobutyl ether | 1% |
| Boric acid | 1.5% |
| Mixed binary acid (C10-C12) | 0.5% |
| Span 80 | 2.5% |
| Sterilizing agent | 1% |
| Benzotrizaole | 0.4% |
| Defoamer | 0.05% |
| Water | 3.1%. |

A preparation method of self-dispersible nano copper with an organic long-carbon chain in the embodiment was the same with that in Embodiment 1, and the difference was that:

On step 1, the carbon-based alcohol compound was isooctanol with dosage of 45.5 g (350 mmol), dosage of phosphorus pentasulfide was 22.2 g (100 mmol), a molar ratio of isooctanol to phosphorus pentasulfide was 3.5:1, and di(2-ethylhexyl)phosphorodithioic acid was finally obtained in step 1.

In step 2, the copper source was copper sulfate pentahydrate with dosage of 37.4 g (150 mmol), 200 mL water was used for dissolving copper sulfate pentahydrate, a reducing agent was 80% hydrazine hydrate with dosage of 120 mL (about 2 mol), dosage of the di(2-ethylhexyl)phosphorodithioic acid was 42.5 g (120 mmol), a molar ratio of copper sulfate pentahydrate to the reducing agent was 3:40, a molar ratio of copper sulfate pentahydrate to di(2-ethylhexyl) phosphorodithioic acid was 5:4 and the organic solvent was petroleum ether 60-90 with dosage of 250 mL.

The prepared nano copper was directly applied to the preparation of the emulsion type cutting fluid, and could be taken as a multi-functional additive to simultaneously substitute the anti-rust agent (petroleum sodium sulfonate), the lubricant (polyether and Span 80) as well as the sterilizing agent, so that the production cost of the cutting fluid was remarkably reduced. The embodiment further provided a reference sample 3 in which nano copper was not added as a comparison, where the formula was as shown in table 5.

TABLE 5

| Formula of referenc example | |
|---|---|
| Additive | Content (mass ratio %, formula without nano copper) |
| Mixed binary acid (C10-C12) | 0.5 |
| Boric acid | 1.5 |
| Benzotrizaole | 0.4 |
| Monoethanolamine | 1.5 |
| Triethanolamine | 1.5 |
| Diethylene glycol monobutyl ether | 1 |
| Oleic acid | 5 |
| Water | 3.1 |
| Petroleum sodium sulfonate | 9 |
| Fatty alcohol polyoxylethylene ether | 2 |
| Span 80 | 5 |
| Sterilizing agent | 2 |
| T22 naphthenic oil | 67.45 |
| Nano copper | 0 |
| Defoamer | 0.05 |
| In total | 100 |

An anti-rust test was performed on the nano copper cutting fluid in Embodiment 3 and the nano copper-free cutting fluid in reference example as shown in the following Table 6.

TABLE 6

| Comparison between the nano copper cutting fluid in Embodiment 3 and the nano copper-free cutting fluid in reference example. | | | |
|---|---|---|---|
| Test Items | Cutting Fluid (containing nano copper) in Embodiment 3 | Cutting Fluid (without nano copper) in reference | Test Standards |
| pH (25° C.) | 9.0 | 9.2 | GB/T 6144 |
| Anti-rust experiment, first-grade grey cast iron, 24 hours | Grade A | Grade A | GB/T 6144 |
| Anti-rust experiment, cast-iron scrap method, 2 hours | No rust spot, grade e | No rust spot, grade e | GB/T 6144 |
| Sedimentation experiment | No sedimentation for six mouths | — | |

The results showed that, for the cutting fluid in Embodiment 3, the nano copper was added to substitute a conventional lubricant and a conventional compression-resisting agent in case of not reducing main performance indexes of the emulsion type cutting fluid, so that the formula system of the cutting fluid was greatly simplified, and the production steps were also simplified while the cost was reduced. Sedimentation experiment was further performed on the cutting fluid in the embodiment, and the test results showed that there were no sediments 6 months later, and therefore, the nano copper was stably and uniformly dispersed in the aqueous aluminum alloy semi-synthetic cutting fluid in the embodiment for a long time. Other performance advantages were the same with those in Embodiment 1 and Embodiment 2, which were not repeated here.

It is apparent that the above-described embodiments are merely illustrative of the examples, and are not intended to limit the embodiments. Other variations or modifications of various forms may be made by a person skilled in the art in light of the above description. There is no need and no way to exhaustively describe all of embodiments. Obvious changes or variations resulting therefrom are still within the scope of the present invention.

The invention claimed is:

1. An application of nano copper in a cutting fluid, wherein the nano copper is self-dispersible nano copper with an organic long-chain hydrocarbon having 8 carbon atoms or higher, wherein the nano copper is a copper metal surface coated with a long-carbon chain organic matter; the long-chain hydrocarbon having 8 carbon atoms or higher organic matter is dialkyldithiophosphate (HDDP) and a derivative thereof; and the cutting fluid is an aqueous cutting fluid.

2. The application of the nano copper in the cutting fluid according to claim 1, wherein the mass percentage, in the cutting fluid, of the nano copper is 1%-10%; and the nano copper is paste with a particle size of 10-50 nm.

3. The application of the nano copper in the cutting fluid according to claim 2, wherein the nano copper substitutes part or all of the functional additives in the cutting fluid, and the functional additives comprise one or more of a preservative, an anti-rust agent, a sterilizing agent, a compression-resisting agent and a lubricant.

4. The application of the nano copper in the cutting fluid according to claim 3, wherein the cutting fluid is an aqueous aluminum alloy semi-synthetic cutting fluid, and comprises the following components in percentage by mass:

| | |
|---|---|
| Nano copper | 1-10% |
| T22 naphthenic oil | 20-30% |
| Potassium oleate | 2-10% |
| Triethanolamine | 3-8% |
| Oleyl alcohol polyoxyethylene ether | 3-8% |
| Methyl diethanolamine | 1-6% |
| Boric acid | 1-6% |
| Oleic acid | 1-5% |
| Coupling agent | 0.5-2% |
| Isopropanolamine | 0.5-2% |
| Benzotrizaole | 0.1-1% |
| Defoamer | 0.01-0.1% |
| and the balance of water, | based on 100% in total. |

5. The application of the nano copper in the cutting fluid according to claim 4, wherein the cutting fluid is an aqueous aluminum alloy semi-synthetic cutting fluid, and comprises the following components in percentage by mass:

| | |
|---|---|
| Nano copper | 3% |
| T22 naphthenic oil | 24% |
| Potassium oleate | 5.8% |
| Triethanolamine | 5.5% |
| Oleyl alcohol polyoxyethylene ether | 5.5% |
| Methyl diethanolamine | 3.5% |
| Boric acid | 3% |
| Oleic acid | 2% |
| Coupling agent | 1% |
| Isopropanolamine | 0.8% |
| Benzotrizaole | 0.5% |
| Defoamer | 0.05% |
| Water, | 45.35%. |

6. The application of the nano copper in the cutting fluid according to claim 3, wherein the cutting fluid is an aqueous magnesium alloy semi-synthetic cutting fluid, and comprises the following components in percentage by mass:

| | |
|---|---|
| Nano copper | 1-10% |
| T22 naphthenic oil | 25-35% |
| Petroleum sodium sulfonate | 8-15% |

-continued

| | |
|---|---|
| Anionic chelating agent | 2-10% |
| Mixed alcohol amine | 5-10% |
| Oleyl alcohol polyoxyethylene ether | 2-5% |
| Fatty alcohol polyoxylethylene ether | 2-5% |
| Tall oil | 3-8% |
| Coupling agent | 5-10% |
| Sterilizing agent | 0.5-2% |
| Benzotrizaole | 0.1-1% |
| Defoamer | 0.01-0.1% |
| and the balance of water, | based on 100% in total. |

7. The application of the nano copper in the cutting fluid according to claim 6, wherein the cutting fluid is an aqueous magnesium alloy semi-synthetic cutting fluid, and comprises the following components in percentage by mass:

| | |
|---|---|
| Nano copper | 3% |
| T22 naphthenic oil | 31.95% |
| Petroleum sodium sulfonate | 11% |
| Anionic chelating agent | 6% |
| Mixed alcohol amine | 6.5% |
| Oleyl alcohol polyoxyethylene ether | 3% |
| Fatty alcohol polyoxylethylene ether | 3% |
| Tall oil | 4% |
| Coupling agent | 8% |
| Sterilizing agent | 1% |
| Benzotrizaole | 0.5% |
| Defoamer | 0.05% |
| Water | 22%. |

8. The application of the copper in the cutting fluid according to claim 3, wherein the cutting fluid is an emulsion type cutting fluid, and comprises the following components in percentage by mass:

| | |
|---|---|
| Nano copper | 1-10% |
| T22 naphthenic oil | 50-70% |
| Petroleum sodium sulfonate | 5-10% |
| Oleic acid | 4-6% |
| Triethanolamine | 1-3% |
| Monoethanolamine | 1-3% |
| Fatty alcohol polyoxylethylene ether | 1-3% |
| Diethylene glycol monobutyl ether | 0.5-2% |
| Boric acid | 1-3% |
| Mixed binary acid (C10-C12) | 0.1-1% |
| Span 80 | 2-5% |
| Sterilizing agent | 0.5-2% |
| Benzotrizaole | 0.1-1% |
| Defoamer | 0.01-0.1% |
| and the balance of water, | based on 100% in total. |

9. The application of the nano copper in the cutting fluid according to claim 8, wherein the cutting fluid is an emulsion type cutting fluid, and comprises the following components in percentage by mass:

| | |
|---|---|
| Nano copper | 3% |
| T22 naphthenic oil | 69.95% |
| Petroleum sodium sulfonate | 7% |
| Oleic acid | 5% |
| Triethanolamine | 1.5% |
| Monoethanolamine | 1.5% |
| Fatty alcohol polyoxylethylene ether | 2% |
| Diethylene glycol monobutyl ether | 1% |
| Boric acid | 1.5% |
| Mixed binary acid (C10-C12) | 0.5% |
| Span 80 | 2.5% |
| Sterilizing agent | 1% |
| Benzotrizaole | 0.4% |
| Defoamer | 0.05% |
| Water | 3.1%. |

* * * * *